United States Patent [19]

Wagner et al.

[11] Patent Number: 4,960,442

[45] Date of Patent: Oct. 2, 1990

[54] FLEXIBLE GRINDING TOOL

[75] Inventors: Eckhard Wagner, Elmshorn; Angelika Eichler, Pinnerberg, both of Fed. Rep. of Germany

[73] Assignee: Norddeutsche Schleifmittel-Industrie Christiansen & Co (GmbH & Co), Fed. Rep. of Germany

[21] Appl. No.: 323,314

[22] Filed: Mar. 14, 1989

[30] Foreign Application Priority Data

Mar. 14, 1988 [DE] Fed. Rep. of Germany ..... 3808426

[51] Int. Cl.[5] ..... C09K 3/14

[52] U.S. Cl. ..... 51/295; 51/298; 51/309; 428/225; 428/242

[58] Field of Search ..... 51/295, 298, 309; 428/225, 242

[56] References Cited

U.S. PATENT DOCUMENTS

| | | | |
|---|---|---|---|
| 3,166,388 | 1/1965 | Riegger et al. | 51/296 |
| 3,906,684 | 9/1975 | Marshall et al. | 51/295 |
| 3,942,959 | 3/1976 | Markööet al. | 51/295 |
| 3,992,178 | 11/1976 | Markööet al. | 51/298 |
| 4,038,047 | 6/1977 | Haywood | 51/295 |
| 4,082,521 | 4/1978 | McGarvey | 51/295 |
| 4,163,647 | 8/1979 | Swiatek | 51/295 |
| 4,225,321 | 9/1980 | Swiatek | 51/295 |
| 4,255,164 | 3/1981 | Butzke et al. | 51/295 |
| 4,256,467 | 3/1981 | Gorsuch | 41/309 |
| 4,317,660 | 3/1982 | Kramis et al. | 51/295 |
| 4,543,106 | 9/1985 | Parekh | 51/295 |
| 4,767,644 | 8/1988 | Yamaguchi et al. | 51/309 |

*Primary Examiner*—Paul Lieberman
*Assistant Examiner*—Willie Thompson
*Attorney, Agent, or Firm*—Chilton, Alix & Van Kirk

[57] ABSTRACT

The back finish of a flexible grinding tool, especially a grinding belt, contains an ingredient which is composed predominantly of plate-like mineral particles, preferably micaceous iron ore. It gives the belt a higher rigidity and better sliding properties on its back.

20 Claims, 2 Drawing Sheets

5 Fig

FLEXIBLE GRINDING TOOL

Figure 1:
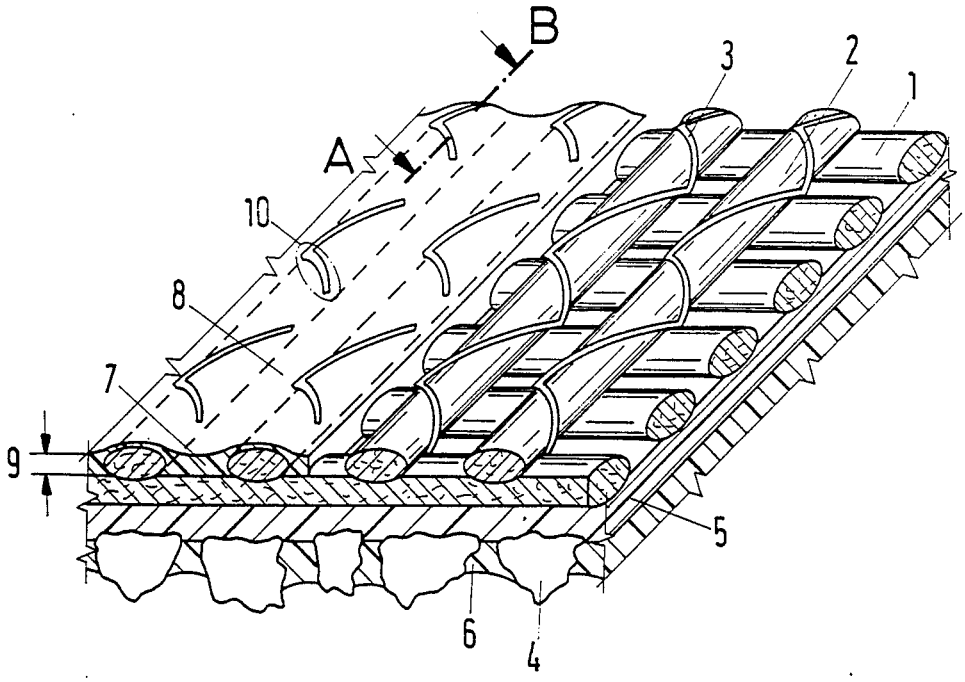

The invention relates to a flexible grinding tool, especially a grinding belt, with a flexible backing which carries a back finish.

In flexible grinding tools, it is often desirable to ensure that the backing has a high strength towards fulling and bending stresses. It is known that, in backings based on fiber material, for example fabric, this property can be improved by using a hardening back finish which is applied in the liquid state and which partially penetrates into the fiber or thread interspaces and partially remains as a layer on the back of the backing. It should have a high inherent strength in view of its reinforcing function and its capacity for resistance to the mechanical stresses of a grinding machine. Those finishes which are comparatively hard in the hardened state are therefore usually used. In contrast to this, substances remaining relatively soft are employed for the so-called core finish which is introduced into the fiber material before the application of the back finish and grain-side finish, in order to prevent the penetration of the side finishes and protect the fibers against possibly aggressive and embrittling influences of the side finishes.

Furthermore, the aim to be achieved by applying the back finish is to smooth the rear of the backing which is generally uneven or rough according to the textile structure. However, it is impossible with conventional finishes to eliminate the unevenness of the back completely, since, after the hardening of the finish the surface structure of the backing exhibits more or less large height differences in the surface of the layer formed by the finish. There are types of sheet-like textile material which have an especially uneven back. These include stitch-bonded fabrics with fiber strands which lie on their back and which are connected by means of a stitch-bonding thread. The fiber strands appear as elevations with intermediate depressions. The stitching threads projecting above the fiber strands attain an even greater height. Thus, in a product available on the market, the distance between the underside of the yarn and the highest point of the stitch-bonding thread can be of the order of 0.3 to 0.5 mm, with a cenler spacing of the fiber strands of 1.8 mm. In the grinding zone, the grinding belt is supported on the supporting structure of the grinding machine at its points which are the highest on its back. If the supporting structure is formed by stationary supporting elements over which the grinding belt slides, the uneven form of the back of the grinding belt can have a highly abrasive effect, especially when the supporting elements are equipped with graphitic sliding coverings which, tensioned by means of pressure bars, are intended to prevent friction between the back of the grinding belt and the pressure-bar surface. Attempts have been made to reduce the roughness of the rear of the backing by means of a nonwoven coating (WO 8//02306), but this involves a very high outlay.

The object on which the invention is based is to reduce the wearing effect of the back of the grinding tool on the supporting structure of the grinding machine and improve the mechanical properties of the grinding tool.

In the solution according to the invention, the back finish contains a plate-like mineral ingredient.

The ingredient reinforces the layer containing it and thereby increases the resistance of the tool. Whereas it has been necessary hitherto to influence this resistance by a suitable choice of the hardness, layer thickness and depth of penetration of the back finish, these parameters can now be chosen with greater freedom. This applies especially to those parameters which relate to the above-explained wearing property of the tool. To that extent, the invention is based on the finding that, on the one hand, the hitherto conventional hard consistencies of the back finish have an adverse influence on the wearing properties of the tool and, on the other hand, a soft consistency of the back finish reduces the wear caused by the tool back.

The softness of the hardened back finish refers primarily to the Shore hardness which should not be higher than 90 Shore A, preferably no higher than 85 Shore A and further preferably no higher than 80 Shore A. Hardness ranges of between 60 and 80 Shore A have proven appropriate. It must be assumed that not only the hardness as such but also the higher wearing capacity of the back finish caused thereby is responsible for the effect according to the invention. Softness within the meaning of the invention will therefore also preferably refer to a relatively high wearing capacity. Back elevations which could otherwise have an abrasive effect are thus removed more quickly, and plane or softly rounded supporting surfaces form at these points. This applies especially to the points which are raised as a result of stitch-bonding threads lying underneath. It does not matter if, after the wear of the back finish, the stitch-bonding threads are exposed at these points, especially since after a short period of operation they are penetrated by a sliding agent, for example graphite dust, which is abraded by the supporting elements. A plurality of fiber bundles of the stitch-bonding threads which are penetrated by the sliding agent can, as a whole, form a low-friction sliding and contact surface of the grinding belt in relation to the supporting element.

Although it is known (U.S. Pat. No. 3,166,388) to use polymer reinforcing particles in a backing composed of a wood-fiber nonwoven, this proposal nevertheless bears no relation to the wearing properties of a grinding-belt back and a back finish.

The softness or wearing capacity of the back finish is appropriately selected so that the highest back points are substantially removed, to form surface portions having a good sliding property, after approximately one tenth of the intended lifetime of the grinding belt. In products currently on the market, this corresponds to a period of time of approximately half an hour.

The reinforcing effect of the plate-like particles is the greater, the more they are arranged parallel to the tool extension. An advantageous embodiment of the invention is therefore distinguished in that, in the alignment of the particles, the directional component parallel to the tool extension predominates. This can also be favorable in terms of the sliding and wearing properties of the tool. A multiple mutual overlapping of adjacent particles also contributes to the reinforcement. This applies especially when the particles are bedded close to the rear surface of the backing and are also at only a short distance from one another. According to the invention, such a state can be achieved by ensuring that, at least in a production phase in which the belt advances horizontally or slightly inclined, the finish is of such low viscosity that the particles are concentrated near the rear surface of the backing. In an advantageous extreme case, the particles form a layer sedimented on the rear of the backing, whilst that part of the back finish located nearer its free surface is substantially free of or clearly more deficient in particles. The advantages of this construction are, on the one hand, the improved reinforcing effect of the particles, and, on the other hand, that they are lacking in the outermost zone of the finish critical for the sliding properties and can therefore be selected without taking into account their sliding properties. In order to sink the particles into the rear surface of the backing, it is advantageous that they have a high specific weight, for example of the order of 5 g/cm$^3$.

Although the claims and the description mention an ingredient, this is not intended to represent a restriction to only one type of particle. On the contrary, different substances can together form the ingredient.

The quantity of ingredient applied to the back of the backing will be at least 3 g/m$^2$, preferably more than 8 g/m$^2$. At the same time, the proportion of ingredient in the hardened back finish will be at least approximately 2% by weight, preferably more than 8% by weight, for example 15% by weight.

Advantageously, the ingredient contains laminar crystalline particles which should also have a preferred alignment in the sliding direction.

Micaceous iron ore has proven outstanding for the purpose. Other types of mica can also be used, appropriately in conjunction with a comparatively soft binder.

While, according to the invention, the sliding properties are improved, the energy transmission from the driving pulley or driving roller to the grinding belt is not impaired.

All binders suitable for lamination can be used, especially synthetic resins and plastic dispersions or mixtures of such substances. Back finishes composed of phenol-resin/latex mixtures have proven successful. The comparatively soft back finish according to the invention preferably contains, as a binder component, in the not yet hardened state phenol resin and an acrylate copolymer dispersion in a weight ratio of 1:2. Heavy and/or easily slidable and/or surface-stable particles which connect firmly to the surrounding binder come under primary consideration as the ingredient. In this respect too, micaceous iron ore, if appropriate in combination with further ingredients of fillers, has proven advantageous, especially with the use of a graphite press-shoe surface as a supporting element.

Figure 2:
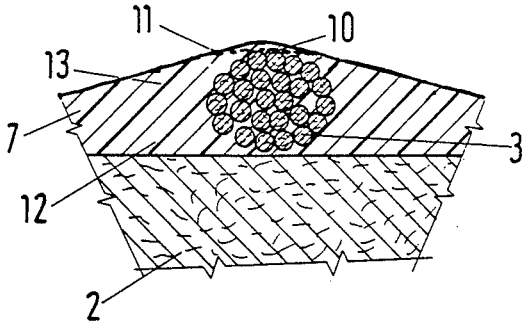
Figure 3:
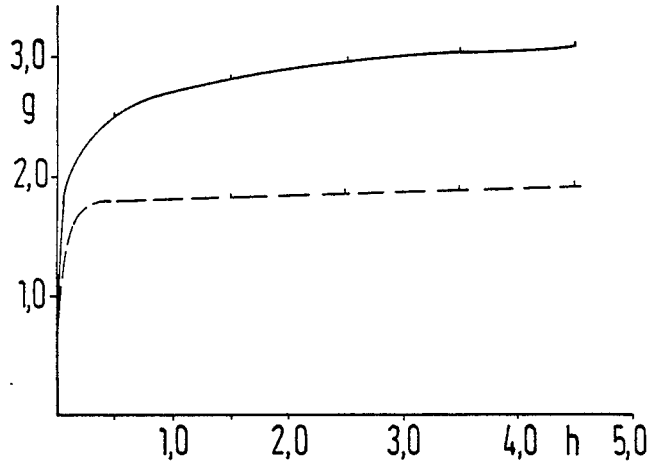
Figure 4:
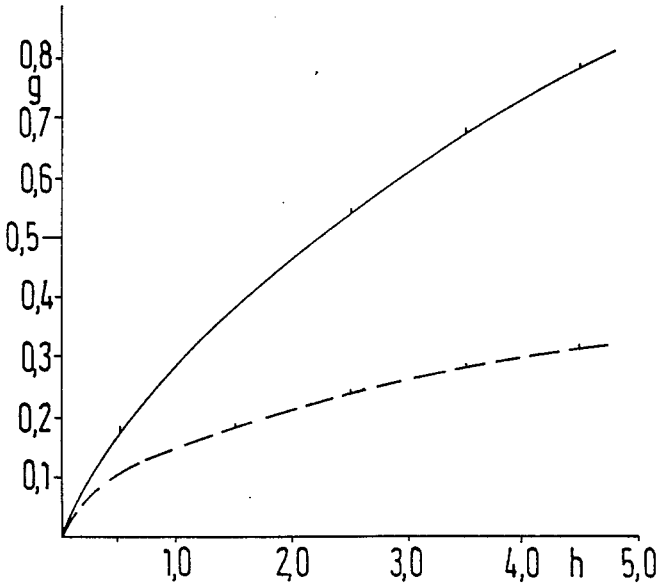
Figure 5:
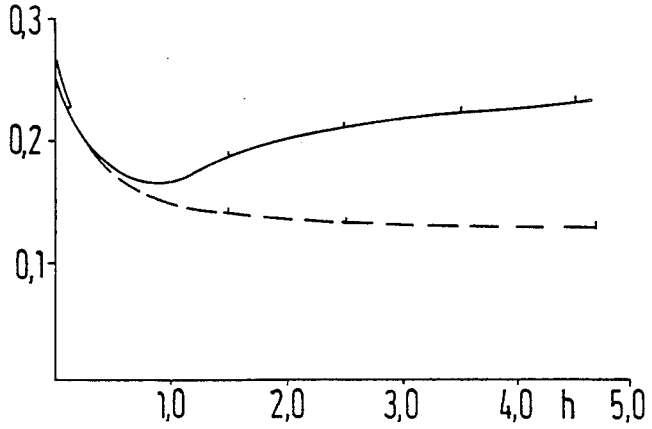

The invention is explained in detail below with reference to the drawing. In this:

FIG. 1 shows a perspective partially sectional view of a cutout from the grinding tool according to the invention on an enlarged scale, FIG. 2 shows a part section AB on a further enlarged scale, and FIG. 3 to 5 show diagrams for comparing the operating mode of the grinding tool according to the invention with the state of the art.

The grinding tool according to FIG. 1 comprises a textile backing composed of a cross-thread structure 1 and a longitudinal-thread structure 2 which are joined together by means of stitch-bonding threads 3 as a stitch-bonded fabric. The textile layer is intrinsically reinforced by means of a core finish not shown in the drawing, carries on the front side a grain layer 4 bound by means of a basic binder layer 5 and a covering binder layer 6 and on the back is equipped with a back finish which is shown only in the left-hand half of FIG. 1. Depressions 8 filled with the back-finish mass 7 form between the contact plane of the fiber strands 1 and 2 and the highest points of the stitch-bonding threads 3. Advantageously, the back finish is designed in such a way that it has a substantially larger thickness 9 in the interspaces 8 than at the elevated points of the fiber strands 2 and stitching threads 3. The surplus is scraped off by means of a doctor blade during the application, so that the highest points of the thread 3 are covered by the back finish 7 only slightly or not at all. As a result of sedimentation, the particles concentrate a little near the backing in the region 12, while the region 13 near the surface is more deficient in ingredient. A certain loss of substance in the layer 7 formed by the back finish subsequently occurs partially during drying and partially as a result of the drawing of binder into the textile layer, so that the layer 7 falls a little into the depressions 8 and the corrugated structure of the backing emerges. Nevertheless, the interspaces are filled to a greater extent than is customary in the state of the art. This too has an advantageous effect on the rigidity of the product. The highest points of the threads 3 either already protrude free of coating after production or lose the thin coating located on them at the latest after a short period of operation, as a result of wear along the line 11, and then form supporting-surface elements 10 for the bearing of those grinding-machine structures which exert pressure on the grinding belt from the rear. In a successfully tested example, the textile material used for the backing was a stitch-bonded fabric, the stitching threads of which appear at regular intervals in the back in such a way that every such surface element 10 occurs on a grid of 1.7×1.1 mm.

The micaceous iron ore which has proven appropriate in connection with the invention is the product which is sold under the trademark MIOX of Messrs. Kärntner Montanindustrie GmbH, Klagenfurt, and the particles of which have an average diameter of 40 microns and thicknesses of 2 to 4 microns.

Comparative tests were conducted with two grinding belts which were identical in terms of the backing formed by a stitch-bonded fabric, the finish and the application of the abrasive grains, and which differed only in that one was finished on the back in the conventional way, whereas the other was equipped with a back finish according to the invention. This was composed of 50 parts by weight of phenol resin and 100 parts by weight of latex dispersion with a solids content of 25 parts and 20 parts of micaceous iron ore MIOX of the abovementioned grading. The application quantity amounted to 25 g/m$^2$ (dry). It was possible to see with the naked eye that the fiber-strand interspaces of the back of the grinding belt were filled to a greater extent in the grinding belt finished according to the invention, the layer thickness on the fiber strands or stitching threads being extremely small. The two belts were used for the grinding of chipboards under conditions conventionally practiced, and a pressure shoe carrying a felt layer on the belt side and on it a graphite layer forming the sliding surface of the back of the band was used in a known way for generating the grinding pressure. The essential results of these comparative tests are shown in FIGS. 3 to 5.

In FIG. 3, the abrasion of the graphite is plotted in grams against the grinding time in hours, specifically in an unbroken line for the conventional belt and a broken line for the belt according to the invention. It is shown that the abrasion is substantially higher in the conventional belt and also increases further considerably after the first half hour of operation, whereas in the belt according to the invention the abrasion is reduced to less than two thirds and virtually no further abrasion occurs after the first half hour of operation.

Even more striking is the reduction achieved according to the invention in the felt abrasion according to FIG. 4, in which the mass decrease of the felt is plotted in grams against the operating time in hours. In particular, it is reduced to less than half the conventional felt loss.

This corresponds to the reduction in the coefficient of friction against the operating time, which is shown in FIG. 5. Whereas, in the conventional belt, this increases again after a minimum reached after approximately one hour of operation, in the belt according to the invention it is reduced to an increasing extent.

It was found that, accordingly, it was also possible to reduce the temperature at a sliding surface. Whereas it rose to approximately 240° C. in the conventional belt, it did not even reach 200° C. in the belt according to the invention.

The rigidity of the belt according to the invention was considerably higher than that of the conventional belt.

We claim:

1. A flexible grinding tool such as a grinding belt comprising:
   a grain layer containing an abrasive on a binder, and
   a flexible backing layer which has a front side that bears on the binder and a rear side which carries a finish that contains an ingredient composed of predominantly plate-like mineral particles.

2. A grinding tool as claimed in claim 1, wherein the particles of the ingredient in the back finish have a predominant directional component parallel to the grain layer.

3. A grinding tool as claimed in claim 2, wherein there is a multiple mutual overlapping of adjacent particles.

4. A grinding tool as claimed in claim 1, wherein the back finish contains a quantity of the ingredient of at least 3 g/m$^2$.

5. A grinding tool as claimed in claim 1, wherein the proportion of the ingredient in the hardened back finish is atleast 2% by weight.

6. A grinding tool as claimed in claim 1, wherein the ingredient is formed by laminar crystalline particles.

7. A grinding tool as claimed in claim 6, wherein the ingredient is a micaceous iron ore.

8. A grinding tool as claimed in claim 1, wherein the hardness of the back finish is no higher than 90 Shore A.

9. A grinding tool as claimed in claim 8, wherein the hardness is no higher than 85 Shore A.

10. A grinding tool as claimed in claim 1, wherein the concentration of the ingredient in the finish is higher in the portion of the finish facing the grain layer than in the portion of the finish facing away from the grain layer.

11. In a grinding belt having an abrasive layer including a first binder and a textile backing layer including a front side facing the abrasive layer and a rear side having a back finish, the improvement wherein the back finish covers substantially all of the textile and contains an ingredient composed predominantly of plate-like mineral particles carried in a second binder.

12. A grinding belt as claimed in claim 11, wherein the particles of the ingredient in the back finish have a predominant directional component parallel to the abrasive layer.

13. A grinding belt as claimed in claim 12, wherein there is multiple mutual overlapping of adjacent particles.

14. A grinding belt as claimed in claim 11, wherein the back finish contains a quantity of the ingredient of at least 3 g/m$^2$.

15. A grinding belt as claimed in claim 11, wherein the proportion of the ingredient in the hardened back finish is at least 2% by weight.

16. A grinding belt as claimed in claim 11, wherein the ingredient is formed by laminar crystalline particles.

17. A grinding belt as claimed in claim 15, wherein the ingredient is a micaceous iron ore.

18. A grinding belt as claimed in claim 11, wherein the hardness of the back finish is no higher than 90 Shore A.

19. A grinding belt as claimed in claim 11, wherein the concentration of the ingredient in the finish is higher in the portion of the finish facing the grain layer than in the portion of the finish facing away from the grain layer.

20. A process for producing a flexible backing layer for a flexible grinding tool such as a grinding belt, the tool having a grain layer containing an abrasive on a binder and the flexible backing layer having front side for bearing on the binder and a rear side that carries a finish, comprising:
   applying the finish as a liquid containing an ingredient composed predominantly of plate-like mineral particles to the rear side of the backing layer, and
   orienting the backing layer substantially horizontally with the front side facing downward;
   whereby the plate-like ingredients concentrate within the finish toward the front side of the backing layer while the finish hardens.

* * * * *

UNITED STATES PATENT AND TRADEMARK OFFICE

CERTIFICATE OF CORRECTION

PATENT NO. : 4,960,442

DATED : October 2, 1990

INVENTOR(S) : Eckhard Wagner et al

It is certified that error appears in the above-identified patent and that said Letters Patent is hereby corrected as shown below:

Column 5, line 3 of claim 5, "atleast" should be --at least-- .

Column 6, line 1 of claim 17, "15" should be --16-- .

Column 6, line 4 of claim 20, --a-- should be inserted after "having" .

Signed and Sealed this

First Day of September, 1992

*Attest:*

DOUGLAS B. COMER

*Attesting Officer*

*Acting Commissioner of Patents and Trademarks*